US007628301B2

(12) United States Patent
Goldman et al.

(10) Patent No.: US 7,628,301 B2
(45) Date of Patent: Dec. 8, 2009

(54) GARMENT HANGER WITH TOP SIZER

(75) Inventors: Stuart Goldman, Wayne, NJ (US); King Keung Kennedy Chan, Hong Kong (HK)

(73) Assignee: Uniplast Industries, Inc., Hasbrouck Heights, NJ (US)

( * ) Notice: Subject to any disclaimer, the term of this patent is extended or adjusted under 35 U.S.C. 154(b) by 0 days.

(21) Appl. No.: 12/117,085

(22) Filed: May 8, 2008

(65) Prior Publication Data

US 2009/0277933 A1 Nov. 12, 2009

(51) Int. Cl.
*A41D 27/22* (2006.01)

(52) U.S. Cl. ..... 223/85; 40/322

(58) Field of Classification Search ..... 223/85, 223/88; 40/322; D6/328
See application file for complete search history.

(56) References Cited

U.S. PATENT DOCUMENTS

| | | | | | |
|---|---|---|---|---|---|
| 4,045,899 | A | * | 9/1977 | Richardson | 40/322 |
| 4,881,836 | A | * | 11/1989 | Blanchard | 40/322 |
| D441,823 | S | | 5/2001 | Blackhurst | |
| D510,198 | S | * | 10/2005 | Willardson | D6/328 |
| D528,807 | S | | 9/2006 | Mainetti | |
| D536,180 | S | | 2/2007 | Wu | |
| D536,181 | S | | 2/2007 | Wu | |
| D547,557 | S | | 7/2007 | Wu | |
| 7,240,813 | B1 | | 7/2007 | Goldman | |
| D552,361 | S | | 10/2007 | Goldman | |
| 7,287,674 | B1 | * | 10/2007 | Sutton et al. | 223/85 |
| D554,378 | S | | 11/2007 | Niederer | |
| 7,303,101 | B2 | | 12/2007 | Goldman | |
| 2006/0006204 | A1 | * | 1/2006 | Mainetti | 223/85 |
| 2006/0213938 | A1 | * | 9/2006 | Gouldson | 223/85 |
| 2007/0062984 | A1 | * | 3/2007 | Louw | 223/85 |
| 2009/0120973 | A1 | | 5/2009 | Ho | |

* cited by examiner

*Primary Examiner*—Gary L Welch
*Assistant Examiner*—Nathan E Durham
(74) *Attorney, Agent, or Firm*—Leason Ellis LLP

(57) ABSTRACT

A top sizer clip according to one embodiment for use with a garment hanger includes a body having a pair of side walls and end walls joined to and extending between the side walls. The body includes a top wall that is joined to upper edges of the side walls and end walls. The top wall partially encloses the body so as to create a hollow body structure that includes an interior compartment defined by the end walls, side walls, and top wall. The top wall includes an opening formed therethrough for receiving a hook member of the hanger. The opening is defined by a pair of opposing first edges and a pair of opposing second side edges that extend between the first edges. The clip also includes a pair of slots being formed along the first edges and extending toward the end walls. The second edges include a pair of interference sections (detents) where a distance between the second edges is at a minimum.

17 Claims, 1 Drawing Sheet

GARMENT HANGER WITH TOP SIZER

TECHNICAL FIELD

The present invention relates to a garment hanger of the type which includes a locking information clip and more particularly, to a top sizer clip for use with a garment hanger.

BACKGROUND

There are a number of different types of garment hangers that are used to hold a number of different articles of clothing or other types of articles, such as linens or other household fabrics. Typically, garment hangers are either formed of a plastic material or a metal material or a combination thereof. Not only do garment hangers come in a variety of different sizes but they also come in a number of different styles that have different types of construction to accommodate different articles which are carried by the hangers.

For example, one type of garment hanger construction is designed to secure knitwear, blouses, slips, strapped garments, including dresses and lingerie. Another type of garment hanger construction is designed to also secure blouses, dresses and other light garments, while another type of garment hanger is designed to secure heavier knitwear, blouses, pants and light weight pant suits. Yet another type of garment hanger is designed to secure coats, jackets and outerwear. The foregoing types of garment hangers can be generally classified as being top garment hangers, while another class of garment hangers is pant hangers, which are those hangers that are designed to secure pants, skirts, and other outfits together. Often times, pant hangers incorporate some type of clamp mechanism to securely grasp and hold the articles of clothing. One will appreciate that there are even more types of garment hangers (e.g., bra/panty hanger) that are intended for particular applications.

One accessory that is often used with a hanger is a size indicator that typically is a small plastic part that attaches to the body of the hanger and has indicia formed thereon that indicates the size or some other identifying mark of the article of clothing that is being held on the hanger. The size indicator can either take the form of a side sizer, where the clip (sizer) attached to the side of a hook member or a top sizer, where the clip attaches more to the top of the hook member.

Conventional top sizer clips are most times custom designed for a specific type or style of hanger (i.e., a matching hanger) and therefore, when they are used with other hangers, the clips tend not to be secured to the hanger but instead either are too small so that they can not be received on the base structure or they are too large and therefore, they wobble on the base structure and can easily become disengaged and fall off the hanger. By not having a secure attachment between the clip and the hanger, the size indicators do not perform their full intended function and instead can easily become misplaced and replacement thereof can result in the wrong size indicator being placed on the hanger which in turn can result in the wrong article of clothing being selected by a consumer or if no size indicator is present, the consumer may rummage through the clothing and leave an untidy display in order to find the proper size.

SUMMARY

A top sizer clip according to one embodiment for use with a garment hanger includes a body having a pair of side walls and end walls joined to and extending between the side walls. The body includes a top wall that is joined to upper edges of the side walls and end walls. The top wall partially encloses the body so as to create a hollow body structure that includes an interior compartment defined by the end walls, side walls, and top wall. A length of the side wall is greater than a length of the end wall, where the length is the distance of one edge of side wall that intersects one end wall to the other edge of the side wall that intersects the other end wall. The top wall includes an opening formed therethrough for receiving a hook member of the hanger. The opening is defined by a pair of opposing first edges and a pair of opposing second side edges that extend between the first edges. The clip also includes a pair of slots being formed along the first edges and extending toward the end walls. The second edges include a pair of interference sections (detents) where a distance between the second edges is at a minimum.

In another embodiment, a top sizer clip in combination with a hanger having a body and a hook member is provided. The top sizer clip has a body having a pair of side walls and end walls joined to and extending between the side walls. The body includes a top wall that is joined to upper edges of the side walls and end walls. The top wall partially encloses the body so as to create a hollow body structure that includes an interior compartment defined by the end walls, side walls, and top wall. The top wall includes an opening formed therethrough for receiving a hook member of the hanger. The opening is defined by a pair of opposing first edges and a pair of opposing second side edges that extend between the first edges. The clip also includes a pair of slots being formed along the first edges and extending toward the end walls. The second edges include a pair of locking sections that extend inwardly into the opening toward one another so as to define a minimum width of the opening. The hook member is coupled to a base section of the hanger body and includes a locking flange that is formed at a distal end of the base section. The locking flange has a width that is greater than a width of an adjacent portion of the base section. In a locked position, the locking flange is disposed above and adjacent the locking sections which prevent removal of the top sizer clip from the hook member.

Other features and advantages of the present invention will be apparent from the following detailed description when read in conjunction with the accompanying drawings.

BRIEF DESCRIPTION OF THE DRAWINGS FIGURES

The foregoing and other features of the present invention will be more readily apparent from the following detailed description and drawings figures of illustrative embodiments of the invention in which.

DETAILED DESCRIPTION OF EMBODIMENTS

Figure 1:
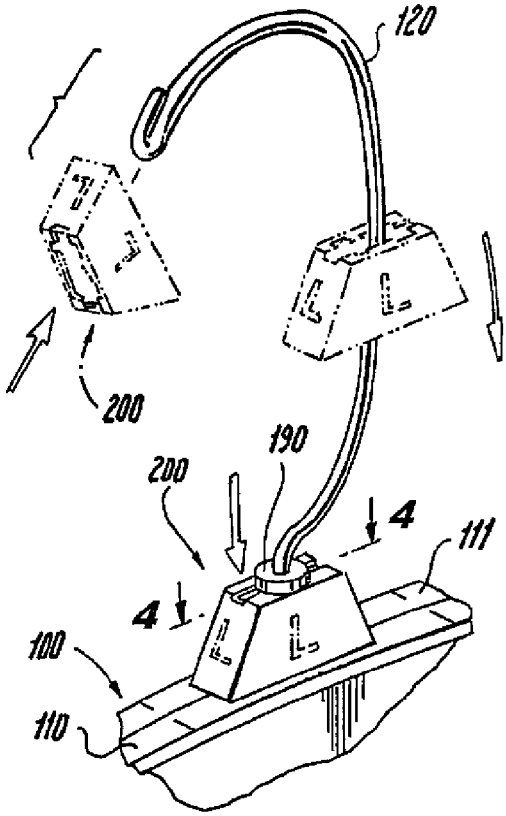
FIG. 1 is a perspective view, partially broken away, of a conventional garment hanger with a top sizer clip according to the present invention attached thereto.

FIG. 1 is a side perspective view of a portion of a garment hanger 100 that includes a body portion 110 (cross bar) having two opposing ends and a hook member 120 that is attached to the body portion 110. A top sizer clip (indicator)

200 according to the present invention is shown attached to the hook member 120. In the illustrated embodiment, the body portion 110 is simply of a flat bar type suitable for holding a top or the like. However, the garment hanger 100 can be of the type that includes a clamp or grip assembly formed near or at each of the first and second ends for holding a pant or the like. The grip assemblies can be integrally formed with the body portion 110 at the first and second ends. It will be appreciated that the top sizer clip indicator 100 can be formed of either an opaque material or transparent material, etc.

The body portion 110, including any grip assemblies, is preferably made as a single piece, molded in plastic using a plastic injection molding machine, as understood by those skilled in the art. Any appropriate plastic can be used, such as styrene, which provides a clear, virtually transparent hanger and alternatively, the hanger 100 can be molded using polypropylene, such as H.I. styrene polypropylene, polypropylene, polyvinylchloride, ABS or other suitable thermoplastics and/or mixtures thereof. As understood by those skilled in the art, the plastic mixture used to mold the hangers can include additional resins for added strength and reinforcement.

As shown in FIGS. 1-5, the illustrated garment hanger 100 is of a swivel hook type construction in that the hook member 120 is swivably or pivotally attached to the body portion 110 at a location that is generally at a midpoint along the body portion 110. The hook member 120 is pivotally received within a bore that is formed in a base structure 130 that is integrally attached at one end to an upper edge 111 of the body portion 110. The bore therefore has a complementary shape as the hook member 120 and thus, for the illustrated embodiment, the bore is annular in shape to complement the circular shape of the hook member 120. The overall shape of the base structure 130 is not critical and it can assume any number of different shapes. For example, while the illustrated base structure 130 has a circular cross-section, it will be appreciated that the base structure 130 can have a number of different shapes, such as rectangular or square, oblong, etc. The hook member 120 is thus frictionally fit within the bore; however, it is permitted to swivel freely therein when a user applied a force to the hook member 120 to produce such movement. This allows the hook member 120 to freely rotate relative to the base structure 130.

According to the illustrated embodiment, the base structure 130 includes first and second side elements 132, 134 that extend outwardly therefrom and are integral with the body portion 110. More specifically, each of the first and second side elements 132, 134 has a first end 136 that is integrally connected to the base structure 130 and an opposing second end 138 that is integrally connected to the upper edge 111 of the body portion 110. While, the precise connection points between the first ends 136 and the base structure 130 and the second ends 138 and the body portion 110 can vary, it is important that a space 140 of sufficient size is formed between each of the first and second side elements 132, 134 and the base structure 130 and upper edge 111.

In the illustrated embodiment, the first and second side elements 132, 134 are elongated, planar walls that extend from the upper edge 111 to a mid to lower end of the base structure 130. The width of the first and second side elements 132, 134 and the base structure 130 can be the same or about the same, e.g., in the illustrated embodiment, it is slightly less than the width of the base structure 130. An angle is thus formed between each of the first and second side elements 132, 134 and the upper edge 111. In this embodiment, the space 140 is generally triangular shaped. The first and second elements 132, 134 do not have to have a linear, planar construction, as it will be appreciated that the first and second side elements 132, 134 can have an arcuate shape. In other words, the first and second side elements 132, 134 can have a curved surface resulting in space 140 having an irregular space.

In accordance with the present invention, the base structure 130 includes a locking flange 190 that is formed along an upper edge 131 thereof. In the illustrated embodiment, the locking flange 190 is an annular shaped locking flange 190 that defines an upper end of the base structure 130. The locking flange 190 is thus a portion of the base structure 130 that has a greater diameter than the other section of the base structure 130. An annular shoulder 192 is defined by an underside of the flange 190 and an outer surface of the underlying base structure 130. This annular shoulder 192 defines a locking edge of the base structure 130. Preferably, the outer surface of the base structure 130 underneath the locking flange 190 is uniform and smooth. In other words, the base structure 130 below the locking flange 190 does not include other surface features, such as locking tabs or locking indents, etc.

FIGS. 1-5 illustrate the top sizer clip 200 according to one embodiment of the present invention. The top sizer clip 200 is formed of a clip body 210 that is essentially hollow and is defined by a first side wall 212, an opposing second side wall 214, a first end wall 216, an opposing second end wall 218, and a top wall 220. The bottom of the top sizer clip 200 is open so as to permit the top sizer clip 200 to be inserted over the hook member 120 and then securely attached to the hanger 100 as described below.

While the top sizer clip 200 can be formed of any number of different materials, the clip 200 is typically made from a plastic material using conventional techniques, such as molding techniques, e.g., injection molding. The clip 200 can be either opaque in nature or semi-transparent or transparent and can be formed to have any number of different colors.

Figure 2:
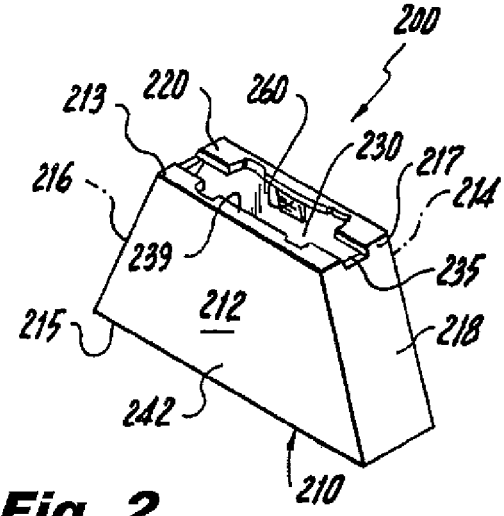
FIG. 2 is a side perspective view of the top sizer clip of FIG. 1.
Figure 3:
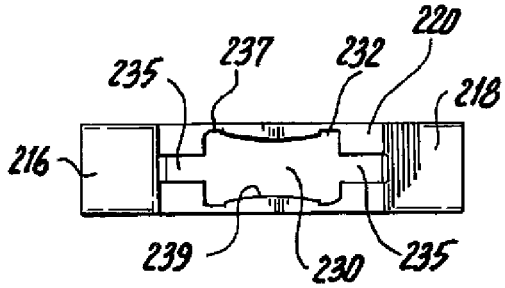
FIG. 3 is a top plan view of the top sizer clip.
Figure 4:
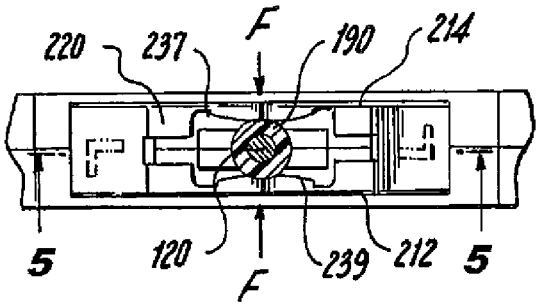
FIG. 4 is a cross-sectional view taken along the line 4-4 of FIG. 1.

As best shown in FIGS. 2 and 3, each of the first and second side walls 212, 214 has a substantially parallelogram shape in that top and bottom edges 213, 215, respectively, thereof are parallel and the two end walls 216, 218 join the side walls 212, 214 at an angle such that the ends are beveled walls with respect to a ground surface (bottom edge 215). The end walls 216, 218 extend between the two side walls 212, 214 and are joined at their top edges 217 to the top wall 220. The end walls 216, 218 can have any number of different shapes; however, the walls 216, 218 typically have either a square or rectangular shape. In the illustrated embodiment, the end walls 216, 218 have a rectangular shape.

The top wall 220 is joined along its peripheral edge to the side walls 212, 214 and the end walls 216, 218. The top wall 220 includes an opening 230 that is formed therethrough and provides an entrance into an interior 240 of the top sizer clip 200. The opening 230 has a predetermined shape and includes a pair of features 235 that are formed in the top wall 220 and communicate with and are associated with the opening 230. More specifically, the features 235 are in the form of notches or slots that are formed along end edges 232 that define the opening 230. For example, each of the features 235 has a circular or arcuate shape. As best shown in FIG. 3, the notches 235 are formed in the same locations of the respective edges 232. For example, the notches 235 are formed in the central sections or regions of the edges 232. The width of the notch 235 is typically less than a width of the hook member 120 to prevent the hook member 120 from becoming lodged within the notch 235.

The end edges 232 that define the opening 230 are located inward relative to the respective top edges 217 of the end walls 216, 218. However, the notches 235 extend to the top edges 217 of the end walls 216, 218. From the view of FIG. 2, it will be appreciated that the notch 235 is visible and divides the top wall 220 into two different end sections. In the illustrated embodiment, the notches 235 are axially aligned and opposite one another (180 degrees apart).

In addition to the end edges 232, the opening 230 is defined by a pair of side edges 237 that extend between the end edges 232.

In one embodiment, as shown, each side edge 237 is not a smooth, uniform edge but rather includes a section 239 of increased width. In other words, section 239 is a non-uniform section that protrudes inwardly into the opening 230. The sections 239 are designed to create interference and serve as locking members or locking detents for engaging the hook member 120 to securely lock the top sizer clip 200 in place as described in detail below. The sections 239 are located opposite one another and typically, are located in the centers of the side edges 237 and thus, in the center of the opening 230.

In the illustrated embodiment, the section 239 is a convex shaped region that is formed along a length of the side edge 237. Moreover, it will be appreciated that the entire side edge 237 can itself have a generally convex shape. In addition, the non-uniform section 239 formed along each side edge 237 can have another shape, such as a rectangular step that is formed centrally along the length of the side edge 237.

The width of the opening 230 is thus at a minimum between the sections 239 since the sections 239 are designed as locking edges that securely lock the top sizer clip 200 in place on the hook member 120.

The body 210 of the top sizer clip 200 has an inner surface 240 and an opposing outer surface 242. The inner surface 240 of the clip 200 is partially defined by an inner face formed as part of each side wall 212, 214. Each inner face of each side wall 212, 214 includes one or more attachment features that facilitate the secure attachment of the top sizer clip 200 to the hanger 100, and more particularly, to the hook member 120. In one embodiment, the attachment feature is in the form of a ramp like structure 260 that is formed along the inner surface 240 and protrudes or extends above the surrounding sections of the inner surface 240. The ramp 260 extends downwardly from the top edge 217 of the side wall 212, 214 and terminates in a bottom edge that is spaced a predetermined distance from the top edge 217 thereof.

The ramps 260 are positioned relative to the increased width sections 239 such that the ramps 260 ride up to the locking sections (detents) 239 of the top wall 220. Since the bottom of the top sizer clip 200 is inserted first onto the hook member 120, the base section 130 of the hook member 120 contacts the bottom edges of the ramps 260 and as the top sizer clip 200 is moved to its locked position, the base section 130 rides up along the ramps 260 to the increased width sections 239.

While the shape and size of the ramp 260 can vary, the dimensions of the ramp 260 are preferably complementary to the dimensions of the opening 230. More specifically, a width of the ramp 260 or at least the top edge thereof is preferably approximately equal to the width of the increased width section 239 and the opening 230. This permits alignment between the opening 230 and the ramp 260.

The process of securely attaching the top sizer clip 200 to the hanger 100 and more particularly, the hook member 120, is now described. The top sizer clip 200 is first aligned relative to the hanger 100 such that the bottom edge of the clip 200 and the interior thereof face the hook member 120. The free end of the hook member 120 is inserted into the interior of the top sizer clip 200 and is then is inserted into and through the opening 230 to permit the top sizer clip 100 to be fed along the length of the hook member 120 toward the upper edge 111 of the body portion 110. The shape and dimensions of the interior of the top sizer clip 200 are selected so as to permit the reception of the base structure 130 therein so as to permit the top sizer clip 200 to be disposed about the base structure 130, with the bottom edge 215 of the clip 200 being disposed proximate to the upper edge 111 of the body portion 110 (as well as being substantially parallel thereto).

More specifically, the distance between the two side walls 212, 214 at their bottom edges is great enough so that the annular flange 190 can be received therebetween. However, the distance between the two side walls 212, 214 is preferably chosen so that the bottom edge of the top sizer clip 200 is snug relative to the outer surface of the annular flange 190. In other words, when the side walls 212, 214 first encounter the annular flange 190, the reception of the annular flange 190 therebetween causes flexing of the side walls 212, 214 which occurs due to the resiliency of the side walls 212, 214. The top sizer clip 200 is thus manufactured from plastic to allow for some degree of flexing of the side walls 212, 214 as the base structure 130 and in particular, the annular flange 190 ride along the inner faces of the side walls 212, 214.

Figure 5:
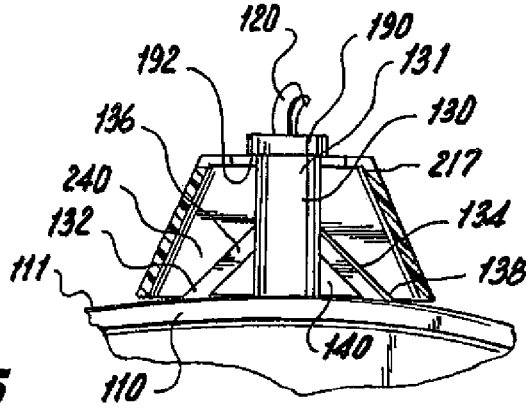
FIG. 5 is a cross-sectional view taken along the line 5-5 of FIG. 4

As the top sizer clip 200 is directed further toward the upper edge 113, the annular flange 190 next comes into contact with the ramp 260. As the annular flange 190 begins to ride up the ramps 260, increased outward flexing of the side walls 212, 214 results. The annular flange 190 continued to ride up the ramps 260 until it clears the top wall 220 of the top sizer clip 200 and the annular flange 190 and the annular flange 190 is located above the top wall 220 in the locked position as shown in FIG. 5.

The diameter of the annular flange 190 can be selected so that it is about equal to a maximum width of the opening 230 (i.e., a maximum distance between the two side walls 212, 214); however, the diameter of the annular flange 190 is greater than the distance between the two increased width sections 239. Consequently, once the annular flange 190 clears the increased width sections 239 (locking detents) the side walls 212, 214 flex inwardly and resume more of the original (unstressed) top sizer clip shape. An audible snap can be heard to indicate that the top sizer clip 200 has reached its locked position on the hook member 120.

In the locked position, the annular flange 190 is disposed above the top wall 220, with the outer edges of the annular flange 190 being disposed above the sections 239. The interference (locking) edges defined by the sections 239 prevent the removal of the top sizer clip 200. Since the distance between the opposing sections 239 is less than the diameter of the annular flange 190, the top sizer clip 200 can not be lifted off of the hook member 120 since the sections 239 are in interference with the annular shoulder 192 that is defined by the underside 194 of the flange 190.

In addition, the notches 235 that are formed along end edges 232 that define the opening 230 are for flexing/stretching so that the top sizer clip 200 can fit over even thicker hangers/hook holders (hook member 120). In particular, the notches 235 introduce weak points in the top wall of the top sizer clip 200 and permit the wall structures of the top sizer clip 200 to flex as the base structure 130 is inserted into the interior of the top sizer clip 200 and causes the walls 212, 214 to flex outwardly.

Because of the general resilient nature of the top sizer clip 200, especially, the side walls 212, 214, if the clip 200 is removed from the base structure 130 by forcibly separate the side walls 212, 214, the side walls 212, 214 may resume, as least in part, their concave shape. However, it will be appreciated that this may not be the case for all top sizer clips 200 and in all uses or applications for the top sizer clip 200, especially when thicker base structures 130 are present and/or when the top sizer clip 200 is secured to the base structure 130 over an extended period of time. Thus, the top sizer clip 200 can be intended for more of a one-time use in that the concave nature of the walls 212, 214 may be permanently deformed as a result of some uses and therefore will not resume its original shape. However, it may be possible for the top sizer clip 200 to be used again even if it is partially deformed and no longer has a distinct concave shape for the walls 212, 214. In most applications, it is extremely difficult to remove the top sizer clip 200 from the hanger 100 once it is snap-lockingly coupled to the base structure 130.

The top sizer clip 200 is directed down over the base structure 130 until the clip 200 is securely attached to the base structure 130 and typically, the top sizer clip 200 is constructed so that once the annular flange 190 clears the sections 239 of the top wall 220 as the top sizer clip 200 is inserted, the bottom edge thereof contacts or is close to the upper edge 113 of the body portion 112 of the hanger 100.

The length of the window 230 (defined as the distance between the end edges 232) is greater than a diameter of the base structure 130 and therefore, the top sizer clip 200 has some side-to-side movement along the upper edge 111 of the body portion 110. This allows proper positioning of the top sizer clip 200 along the body portion 110.

The provision of annular flange 190 and the construction of the top sizer clip 200 provides a very effective manner of securely locking the top sizer clip 200 on the hanger 100. It will be appreciated that the side walls 212, 214 have greater flexing action along the bottom and middle sections thereof and therefore, the clip 200 can receive and accommodate the annular flange 190 as it travels within the clip interior; however, the flexing action of the clip 200 at the top is less and therefore, it is difficult to separate the side walls 212, 214 a sufficient distance to allow the locking edges 239 to clear the annular flange 190. In other words, it is very difficult to remove the top sizer clip 200 since it requires the expansion of the locking detents 239 that are located at the top portion of the clip 200 in an area that is not as resilient as the bottom sections of the clip 200. In addition, the presence of the ramp structures promotes a greater flexing of the locking detents 239 in an upward direction as the locking flange 190 is inserted into the opening 230 as opposed to the flexing properties of the locking detents 239 in the opposite direction toward the bottom edges of the clip 200.

The top sizer clip 200 is adapted to be used with hangers that have different base sections so long as at least a portion of the base section can be received through the opening 230 and a frictional or locking fit results between the clip 200 and the base section 130.

While exemplary drawings and specific embodiments of the present invention have been described and illustrated, it is to be understood that the scope of the present invention is not to be limited to the particular embodiments discussed. Thus, the embodiments shall be regarded as illustrative rather than restrictive, and it should be understood that variations may be made in those embodiments by workers skilled in the art without departing from the scope of the present invention as set forth in the claims that follow, and equivalents thereof. In addition, the features of the different claims set forth below may be combined in various ways in further accordance with the present invention.

What is claimed is:

1. A top sizer clip for use with a garment hanger comprising: a body having a pair of side walls and end walls joined to and extending between the side walls, the body including a top wall that is joined to upper edges of the side walls and end walls, the top wall partially enclosing the body so as to create a hollow body structure that includes an interior compartment defined by the end walls, side walls, and top wall, and wherein a length of the side wall is greater than a length of the end wall, the length being the distance of one edge of side wall that intersects one end wall to the other edge of the side wall that intersects the other end wall, wherein the top wall includes an opening formed therethrough for receiving a hook member of the hanger, the opening defined by a pair of opposing first edges and a pair of opposing second edges that extend between the first edges, wherein a first end of the second edge is closer to one end wall and a second end of the second edge is closer to an opposite end wall, a pair of slots being formed along the first edges and extending toward the end walls, wherein the second edges includes a pair of interference sections each having a convex shape such that a distance between the second edges across the opening is at a minimum at a center of the opening, the interference sections being part of a topmost surface of the clip.

2. The top sizer clip of claim 1, wherein the first edges are at least substantially parallel to the end walls and the second edges are at least substantially parallel to the side walls.

3. The top sizer clip of claim 1, wherein the pair of slots are formed opposite one another.

4. The top sizer clip of claim 3, wherein the opening is generally rectangular shaped and the slots are square shaped.

5. The top sizer clip of claim 1, wherein the convex shaped interference sections protrude inwardly towards one another, wherein opposing ends of the convex shaped interference section terminate prior to the pair of slots with the opening having an increased width in locations between the ends of the interference section and the slots.

6. The top sizer clip of claim 1, wherein the interference section is a step formed along the second edge.

7. The top sizer clip of claim 1, further including a pair of ramp structures formed along inner surfaces of the side walls below the top wall, wherein first ends of the ramp structures terminate at the interference sections.

8. The top sizer clip of claim 7, wherein the ramp is inclined toward the interference section.

9. A top sizer clip in combination with a hanger having a body and a hook member comprising:

a top sizer clip body having a pair of side walls and end walls joined to and extending between the side walls, the body including a top wall that is joined to upper edges of the side walls and end walls, the top wall partially enclosing the body so as to create a hollow body structure that includes an interior compartment defined by the end walls, side walls, and top wall, wherein the top wall includes an opening formed therethrough for receiving a hook member of the hanger, the opening defined by a pair of opposing first edges and a pair of opposing second side edges that extend between the first edges, a pair of slots being formed along the first edges and extending toward the end walls, wherein the second edges include a pair of convex shaped locking detents that extend inwardly into the opening toward one another so as to define a minimum width of the opening at a center thereof, wherein a first end of the locking detent is closer to one end wall and a second end of the locking detent is closer to an opposite end wall, the hook member being coupled to a base section of the hanger body and including a locking flange that is formed at a distal end of the base section, the locking flange having a width that is greater than a width of an adjacent portion of the base section such that the base section has a maximum width at the distal end; wherein in a locked position, wherein the locking flange extends about an entire periphery of the base section and an underside of the locking flange is disposed above and adjacent the locking detents such that the locking flange at least partially covers the locking detents to prevent removal of the top sizer clip from the hook member.

10. The combination of claim 9, wherein the base section comprises a cylindrical shaped protrusion that extends upwardly from a top edge of the hanger body which is in the form of an elongated bar, the base section terminating in the locking flange.

11. The combination of claim 10, wherein the locking flange comprises an annular shaped flange.

12. The combination of claim 10, wherein a maximum width of the opening located between the locking detents and the slots is about equal to a maximum width of the locking flange.

13. The combination of claim 9, wherein the top sizer clip is formed of a plastic material such that the side walls thereof are resilient and can flex outwardly to accommodate the locking flange as the top sizer clip is inserted onto the hook member and moved to the locked position in which the entire locking flange is disposed above the top sizer clip which is located between the body of the hanger and an underside of the locking flange.

14. The combination of claim 9, further including a pair of ramp structures formed along inner surfaces of the side walls, the ramp structures being inclined toward and terminating at the locking sections so as to cause outward flexing of the side walls as the locking flange rides therealong prior to being received in the opening and clearing the locking detents.

15. The combination of claim 9, wherein the locking detent is a portion of the second edge that protrudes inwardly toward the opposing second edge as a result of the convex shaped thereof.

16. The combination of claim 9, wherein the base structure extends perpendicularly up from a top edge of the hanger body and a locking shoulder is formed between an underside of the locking flange and the adjacent base structure, the locking detents being disposed below the locking shoulder in the locked position due to an outer diameter of the locking flange being greater than a minimum distance between the locking detents.

17. A top sizer clip in combination with a hanger having a body and a hook member comprising:

a top sizer clip body having a pair of side walls and end walls joined to and extending between the side walls, the body including a top wall that is joined to upper edges of the side walls and end walls, the top wall partially enclosing the body so as to create a hollow body structure that includes an interior compartment defined by the end walls, side walls, and top wall, wherein the top wall includes an opening formed therethrough for receiving a hook member of the hanger, the opening defined by a pair of opposing first edges and a pair of opposing second side edges that extend between the first edges, wherein each second edge includes a locking detent in the form of a step, formed along the second edge, that extends inwardly into the opening toward the other opposing locking detent so as to define a first width of the opening, the hook member being coupled to a base section of the hanger body and including a locking flange that is formed at a distal end of the base section and represents a topmost section of the base section, the locking flange extending about an entire periphery of the base section and having a width that is greater than a width of an adjacent portion of the base section and is greater than the first width, the clip body having a pair of ramp structures formed along inner surfaces of the side walls and perpendicular to the locking detents, the ramp structures being inclined toward and terminating at free inner edges of the locking detents; wherein in a locked position, an underside of the locking flange is disposed above the locking detents such that the locking flange at least partially covers the locking detents which prevents removal of the top sizer clip from the hook member since the locking flange has a greater width than the first width.

* * * * *